United States Patent [19]

Sayward, Jr.

[11] Patent Number: 4,956,544

[45] Date of Patent: Sep. 11, 1990

[54] OVERHEAT PROTECTED ELECTRIC CARTRIDGE HEATER

[75] Inventor: Samuel S. Sayward, Jr., Danvers, Mass.

[73] Assignee: Hotwatt Inc., Danvers, Mass.

[21] Appl. No.: 224,470

[22] Filed: Jul. 26, 1988

[51] Int. Cl.[5] ..... H05B 1/02; H05B 3/82; F24H 1/20

[52] U.S. Cl. ..... 219/335; 219/306; 219/316; 219/331; 219/437; 219/523; 219/544; 337/380; 338/238; 338/243

[58] Field of Search ..... 219/335, 336, 328, 331, 219/306, 316, 318, 322, 323, 436–438, 441, 442, 510, 512, 523, 419, 450, 516, 544; 337/381, 380; 338/238, 243, 239

[56] References Cited

U.S. PATENT DOCUMENTS

| | | | |
|---|---|---|---|
| 1,505,179 | 8/1924 | Whiteley | 219/306 X |
| 1,777,862 | 10/1930 | Schwedler | 219/328 X |
| 1,916,111 | 6/1933 | Kump | 337/376 |
| 2,192,655 | 3/1940 | Smith | 219/441 |
| 2,481,384 | 9/1949 | Blackwell | 219/331 X |
| 2,541,321 | 2/1951 | Badger | 219/436 |
| 2,784,292 | 3/1957 | Haloski | 219/323 X |
| 2,825,790 | 3/1958 | Sims | 219/419 X |
| 2,987,919 | 6/1961 | Kirby | 337/380 X |
| 3,278,395 | 10/1966 | Rubinowitz | 219/331 X |
| 3,399,295 | 8/1968 | Chaustowich | 219/336 X |
| 3,497,677 | 2/1970 | Blain | 219/437 X |
| 3,947,656 | 3/1976 | Lodi | 338/238 X |
| 4,208,570 | 6/1980 | Rynard | 219/322 X |
| 4,303,827 | 12/1981 | Kyles | 219/328 X |
| 4,358,667 | 11/1982 | Johnson et al. | 219/331 |
| 4,480,174 | 10/1984 | Hummel | 219/331 |
| 4,543,473 | 9/1985 | Wells et al. | 219/335 X |
| 4,685,037 | 8/1987 | Akiyama et al. | 337/381 X |

FOREIGN PATENT DOCUMENTS

| | | | |
|---|---|---|---|
| 1477689 | 3/1967 | France | 219/331 |
| 363735 | 9/1962 | Switzerland | 219/328 |

*Primary Examiner*—Anthony Bartis

*Attorney, Agent, or Firm*—Joseph S. Iandiorio

[57] ABSTRACT

An electric cartridge heater for use as an immersion heater in a steam table tank has a tubular elongate stainless steel sheath with a curved inner surface attached to a riser tube adapted to be connected to a wall of the tank and contains an electric heater element. A copper heat transfer member having an enlarged, curved surface complementary to the inner surface of the sheath is urged into close, intimate thermal contact therewith and transfers heat from the sheath to a bimetal thermostat for turning off the heater element in response to a rise in temperature of the sheath above a predetermined level.

12 Claims, 3 Drawing Sheets

OVERHEAT PROTECTED ELECTRIC CARTRIDGE HEATER

FIELD OF INVENTION

This invention relates to self-protected immersible cartridge heater having an overheat protection device and more particularly to such a device for interrupting current flow to an electrical heater element in an overheat condition.

BACKGROUND OF INVENTION

Immersion heaters are commonly used in a variety of food equipment such as steam tables. Generally these heaters are electrical heating devices placed at the bottom of a water tank and are used for heating water to produce steam, which is primarily used for heating food. These heaters generally consist of one or more copper tubes bent in various coil configurations, each containing an insulated electrical coil which transmits heat through the copper tubing to the water.

Heaters are typically protected against overheat hazards by a thermally activated mechanical switch placed elsewhere in the heater assembly. The mechanical switch commonly used consists of a heat sensitive actuator rod which expands sufficiently in an overheat condition to actuate a microswitch which controls power to the heaters.

Over a period of time, however, problems occur when the copper tubes of the heater and actuator rod corrode. When the heater corrodes, lime deposits form along the exterior surfaces of the tubes. These deposits eventually build up and bridge the gaps between the windings of each of the tubes, creating hot spots which cause heater failure. It is often a difficult task to remove these lime deposits to avoid heater failure because of the size and location of these devices.

The thermally activated actuator rod corrodes independently. Corrosion causes the actuator rod to deteriorate so that it fails to operate properly; sometimes it fails to operate at all. Under these conditions damage can occur to the equipment and environs and/or the heater may destroy itself.

SUMMARY OF INVENTION

It is therefore an object of this invention to provide an improved overheat protection device.

It is a further object of this invention to provide such an overheat protection device which is not susceptible to corrosion.

It is a further object of this invention to provide an overheat protection device which is completely enclosed and tamper-proof.

It is a further object of this invention to provide an overheat protection device which is particularly suitable for protecting immersible cartridge heaters.

It is a further object of this invention to provide an overheat protection device which directly monitors the heat at the sheath of the cartridge heater to protect it from overheating.

It is a further object of this invention to provide an overheat protection device which is placed within a cartridge heater to protect it from corrosion.

This invention results from the realization that a truly effective overheat protection device can be made for protecting a cartridge heater from overheating by a heat sensing element placed within the cartridge and against the sheath of the cartridge heater in an area remote from the heating elements for sensing overheat conditions.

This invention features an overheat protection device for a cartridge heater having a heater element enclosed within a sheath. The device includes a heat transfer member for engaging the inner surface of the sheath in an area of the sheath remote from the heater element. Means are provided for urging the heat transfer member into close, intimate, thermal contact with the inner surface of the sheath. The heat transfer member may engage the sheath in an area that proximates the temperature of the heater element. Current flow to the heater element is controlled by switch means. A thermally sensitive element responsive to a rise in the temperature of the sheath above a predetermined level for actuating the switch means to interrupt current flow to the heater element to prevent the cartridge heater from overheating.

The heat sensing device may be disposed between two separate, spaced-apart sections of the heater element. The heat transfer member may also be shaped to closely conform to the shape of the inner surface of the sheath.

DISCLOSURE OF PREFERRED EMBODIMENT

Other objects, features and advantages will occur from the following description of a preferred embodiment and the accompanying drawings, in which.

This invention features an improved heat sensing device for a cartridge heater for deactivating heating elements used to heat water of a steam table to avoid overheating the equipment which generally occurs when the water level drops below a predetermined threshold. The cartridge heater is constructed to support the heat sensing device within the cartridge and to protect it from corrosion.

Figure 1:
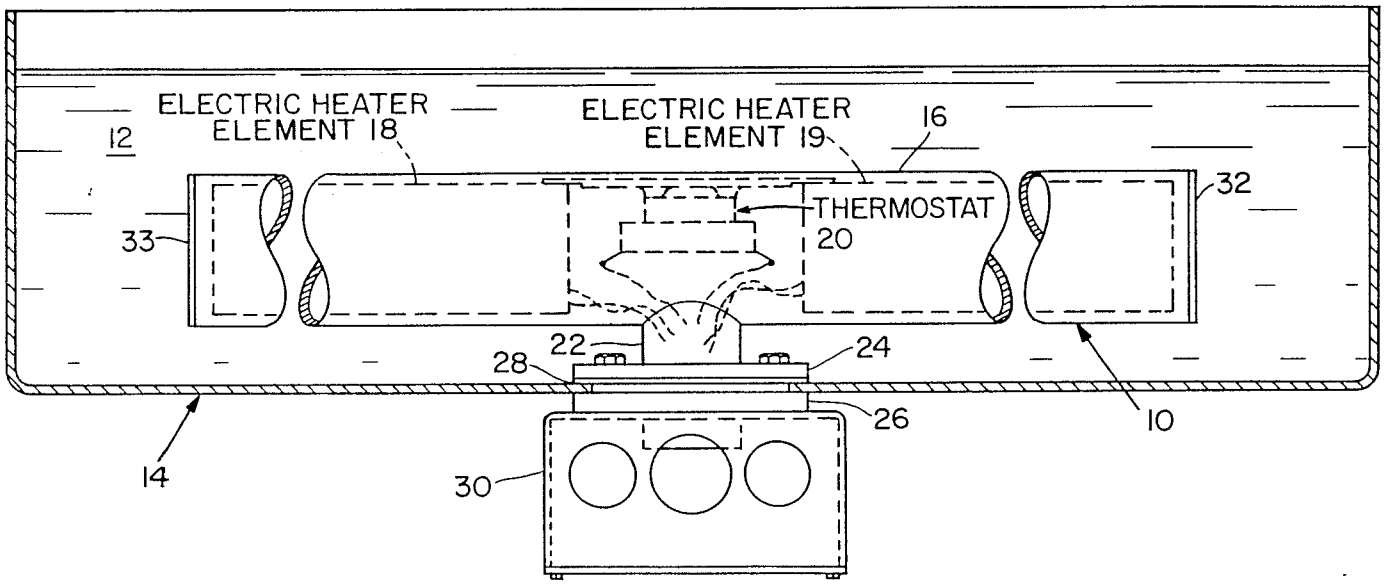
FIG. 1 is a side sectional view of a heater assembly, according to this invention, disposed in a tank of water to be heated.

Cartridge heater 10 is immersed in water 12 contained in tank 14 as shown in FIG. 1. Cartridge heater 10 includes an elongated sheath 16 which houses electrical heating elements 18 and 19 and a heat sensitive device 20. Sheath 16 is supported by a riser tube 22 which is secured to the bottom of tank 14 by flanges 24 and 26. A seal 28 disposed between flanges 24 and 26 provides a watertight seal. Riser tube 22 provides a conduit for external electrical connections for elements 18 and 19 and device 20 at junction box 30.

In the preferred embodiment, sheath 16 and riser tube 22 are made from stainless steel which resists corrosion. Sheath 16 includes end caps 32 and 33 which are welded to sheath 16 to form a watertight seal, after elements 18 and 19 and heat sensitive device 20 are properly placed within sheath 16. The joint between sheath 16 and riser tube 22 is similarly welded.

Figure 4:
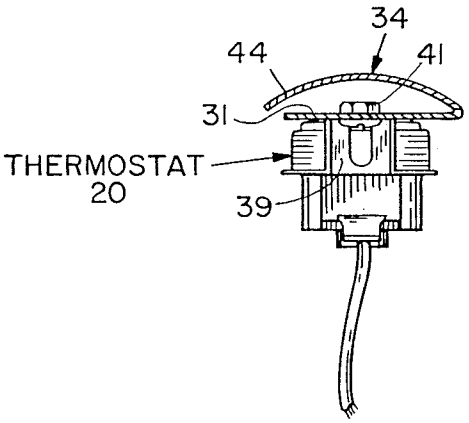
FIG. 4 is an end view of the heat sensing device of FIG. 2.
Figure 2:
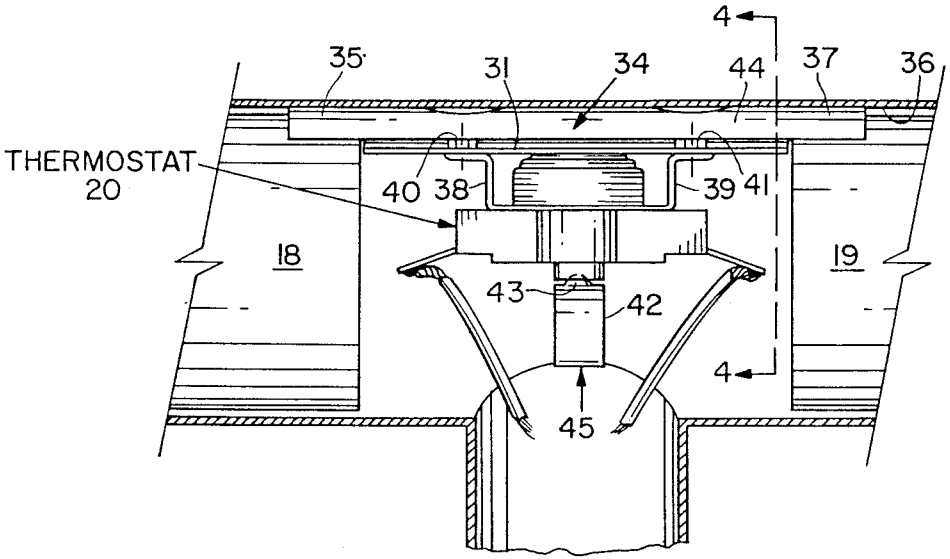
FIG. 2 is a side sectional view of the heat sensing device illustrated in FIG. 1.
Figure 3:
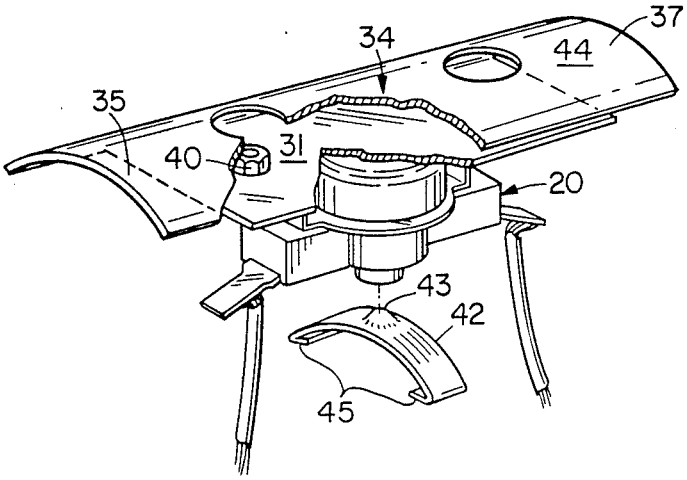
FIG. 3 is a perspective view of the heat sensing device of FIG. 2.

Heat sensitive device 20, shown in FIG. 2, includes an enlarged heat transfer member 34 for engaging the inner surface area of sheath 16 in an area 36 that is remote from elements 18 and 19. Member 34, which is preferably made of copper, is secured to posts 38 and 39 of heat sensitive device 20 by nut and bolt assemblies 40 and 41 which pass through base portion 31 of heat transfer member 34 as shown in FIGS. 2, 3 and 4 As shown in FIGS. 3 and 4, member 34 has a smooth curve surface 44 that conforms to the interior surface of sheath 16 to provide intimate, thermal contact with sheath 16. Shoulders 35 and 37 at each end of curved surface 44 are disposed between sheath 16 and heating elements 18 and 19 for securing the device 20 between the elements. Device 20 is urged against sheath 16 by a leaf spring 42, which includes legs 45 that are biased against the interior wall of sheath 16 and a nipple 43 at its apex that fits into a cavity at the base of device 20.

During operation heating elements 18 and 19 transfer heat to water 12 via sheath 16. When the water level drops below the top of cartridge heater 10, the temperature of the exposed sheath 16 increases. Heat sensitive device 20, which may be a bimetal thermostat, detects the increase in temperature and operates as a switch for interrupting the current to heating elements 18 and 19 when the temperature exceeds a predetermined temperature. This prevents heating elements 18 and 19 from overheating and causing damage to the equipment and/or causing the heater element to destroy itself.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A cartridge heater having an overheat protection device, for use in a steam table tank, the heater comprising:

a riser tube attached to the inside of the tank;

a tubular elongate sheath having a curved inner surface attached to said riser tube;

an electric heater element inside said sheath;

a heat transfer member having an enlarged, curved surface complementary to the curved inner surface of said sheath for engaging the inner surface of said sheath in an area of said sheath remote from said heater element;

means urging said heat transfer member into close, intimate, thermal contact with the inner surface of said sheath; and switch means for turning the heater element on and off, said switch means including a thermally sensitive element responsive to a rise in the temperature of said heat transfer member above a predetermined level for actuating said switch means to interrupt current flow to the heater element to prevent it from overheating.

2. The cartridge heater of claim 1 in which said heat transfer member engages said sheath in an area that proximates the temperature of said heater element to prevent it from overheating.

3. The cartridge heater of claim 1 in which the heater element includes two separate, spaced-apart sections and said heat transfer member is between said sections.

4. The cartridge heater of claim 1 in which said heater transfer member is shaped to closely conform to the shape of said inner surface of the sheath.

5. The cartridge heater of claim 1 in which said heat transfer member is copper.

6. The cartridge heater of claim 1 in which said sheath is stainless steel.

7. The cartridge heater of claim 1 in which said thermally sensitive element includes a bimetal thermostat.

8. A cartridge heater for a steam table tank, comprising:

a riser tube attached to the inside of the tank;

a tubular elongate sheath having a curved inner surface attached to said riser tube;

an electrical heater element inside said sheath, a thermally sensitive switch for controlling current flow to said heater element in response to a rise in temperature of said sheath above a predetermined level to interrupt current flow to said heater element to prevent it from overheating;

a heat transfer member having an enlarged curved surface for engaging the inner surface of said sheath for transferring heat from said sheath to said switch; and means urging said heat transfer member into close, intimate thermal contact with the inner surface of said sheath.

9. The of claim 8 in which said switch includes electrical terminals connected by electrical leads to an external switch for disabling said heater element.

10. The of claim 8 in which said heat transfer member is in thermal contact with said sheath in an area remote from said heater element.

11. The of claim 8 in which said cartridge heater contains two heater elements.

12. The of claim 11 in which said switch is positioned between heater elements in an area remote from heater elements.

* * * * *